US005146954A

United States Patent [19]

Ostyn et al.

[11] Patent Number: 5,146,954

[45] Date of Patent: Sep. 15, 1992

[54] LOOM CLOTH BEAM REPLACEMENT IN WEAVING MACHINES

[75] Inventors: Geert Ostyn, Moorslede; Kristof Roelstraete, Zwevegem, both of Belgium

[73] Assignee: Picanol N.V., Naamloze vennootschap, Belgium

[21] Appl. No.: 714,843

[22] Filed: Jun. 13, 1991

[30] Foreign Application Priority Data

Jun. 19, 1990 [BE] Belgium ..... 09000623

[51] Int. Cl.[5] ..... D03D 49/00

[52] U.S. Cl. ..... 139/1 R; 139/291 R; 242/66

[58] Field of Search ..... 139/1 R, 291 R; 242/56 R, 66, 58.1, 59, 68.2

[56] References Cited

U.S. PATENT DOCUMENTS

| | | | |
|---|---|---|---|
| 3,493,187 | 2/1970 | Gottschalk | 242/68.2 |
| 4,000,863 | 1/1977 | Straujups | 242/66 X |
| 4,606,381 | 8/1986 | Suwa et al. . | |
| 4,892,119 | 1/1990 | Hugo et al. . | |

FOREIGN PATENT DOCUMENTS

| | | | |
|---|---|---|---|
| 1000684 | 3/1989 | Belgium . | |
| 0296114 | 12/1988 | European Pat. Off. | 139/1 R |

*Primary Examiner*—Andrew M. Falik
*Attorney, Agent, or Firm*—Bacon & Thomas

[57] ABSTRACT

A method and a device for replacing a cloth beam in a weaving machine utilize the steps of removing a cloth beam from a winding device, pressing an empty cloth beam against a fabric and against a guide piece such that the fabric is turned over the guide piece, subsequently releasing the fabric, and driving the empty cloth beam such that the fabric is wound thereon, and finally mounting the empty cloth beam in the winding device.

14 Claims, 9 Drawing Sheets

Fig. 15
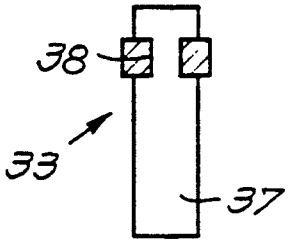
Fig. 21
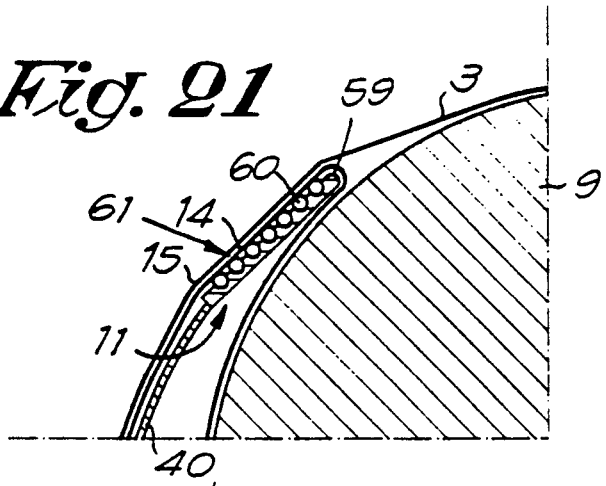
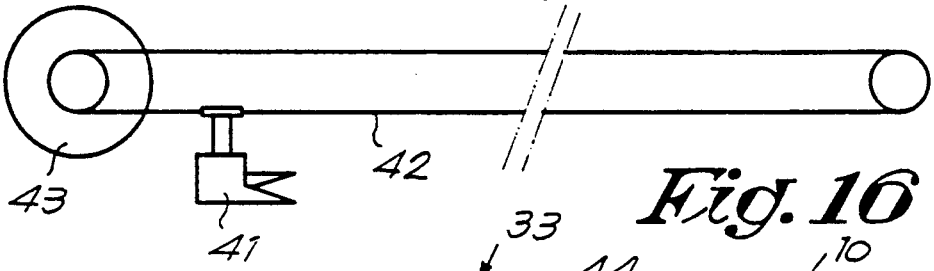
Fig. 16
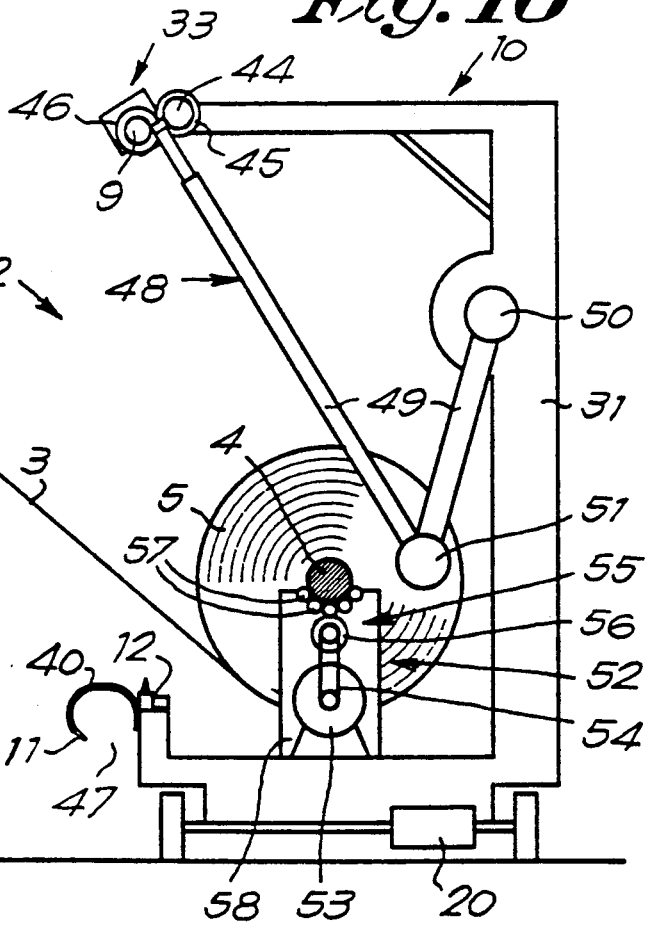
Fig. 18

LOOM CLOTH BEAM REPLACEMENT IN WEAVING MACHINES

BACKGROUND OF THE INVENTION

A variety of methods and devices for replacement of a cloth beam are known. However, none of these methods and devices has proven completely satisfactory, due to the fact that an extra press roll and other means to start up the winding, such as adhesive tape, hooks, suction openings, and so forth, are required by the prior methods and devices, and also because the prior methods and devices usually require interruption of the weaving process during replacement of the beam.

SUMMARY OF THE INVENTION

The present invention concerns a method and device for replacing a cloth beam in weaving machines, in particular for replacing a cloth beam by an empty cloth beam.

In particular, the invention concerns a method and device offering the advantage that the replacement of the cloth beam can be executed in a relatively simple manner, as no extra press roll or any other means to start up the winding such as adhesive tape, hooks, suction openings, etc. is required.

The invention also concerns a method and device having the advantage of simple replacement of the cloth beam with the additional advantage that the weaving does not need to be interrupted during the replacement of the cloth beam.

To this end, the method according to the invention includes the steps of removing a cloth beam to be replaced from a winding device, pressing an empty cloth beam against the fabric, and putting the empty cloth beam against a guide piece stretching out along the width of the fabric such that the fabric is turned over the guide piece and extends around substantially the entire circumference of the cloth beam, and from there extends towards the winding device, enveloping the portion of the fabric extending towards the winding device that is turned over the guide piece and lies between the extending portion and the guide piece. The inventive method also includes the steps of releasing the part of the fabric that is situated, according to the moving direction of the fabric, beyond the empty cloth beam, driving the empty cloth beam such that the part of the fabric that is situated beyond the empty cloth beam such that the part of the fabric that is situated beyond the empty cloth beam according to the moving direction of the fabric is wound between the guide piece and the fabric stretching out towards the winding device, and mounting the empty cloth beam in the winding device.

In preference, the fabric is to be kept taut since the cloth beam to be replaced is removed and is not cut loose until the empty cloth beam makes contact with the guide piece.

In order to realize the method according to the invention, use should be made of a device which includes means for removing a cloth beam to be replaced from a winding device, a guide piece stretching out according to the width of the fabric, a guide piece stretching out according to the width of the fabric, means to put the empty cloth beam against the fabric and against the guide piece such that the fabric is turned over the guide piece, extends over substantially the entire circumference of the cloth beam, and from there extends towards the winding device, the portion extending towards the winding device enveloping the fabric that lies in between that portion and the portion which is already turned over the guide piece. The device for implementing the inventive method also includes means for placing the empty cloth beam in the winding device, means for releasing the part of the fabric that is situated beyond the empty cloth beam according to the moving direction of the fabric; and drive means for driving the empty cloth beam.

In preference, the guide piece consists of a slat attached to elastic, arched connecting pieces.

BRIEF DESCRIPTION OF THE DRAWINGS

In order to better explain the characteristics of the invention, by way of example only and without being limitative in any way, the following preferred embodiments are described with reference to the accompanying drawings where:

FIG. 15 is a cross-section according to line XV—XV in FIG. 14;

FIG. 16 shows a view according to arrow F16 in FIG. 11;

FIGS. 18 to 20 show the device represented in FIG. 17 in various positions;

FIG. 21 represents a variant of the part indicated in FIG. 7 as F21.

DETAILED DESCRIPTION OF THE PREFERRED EMBODIMENTS

Figure 1:
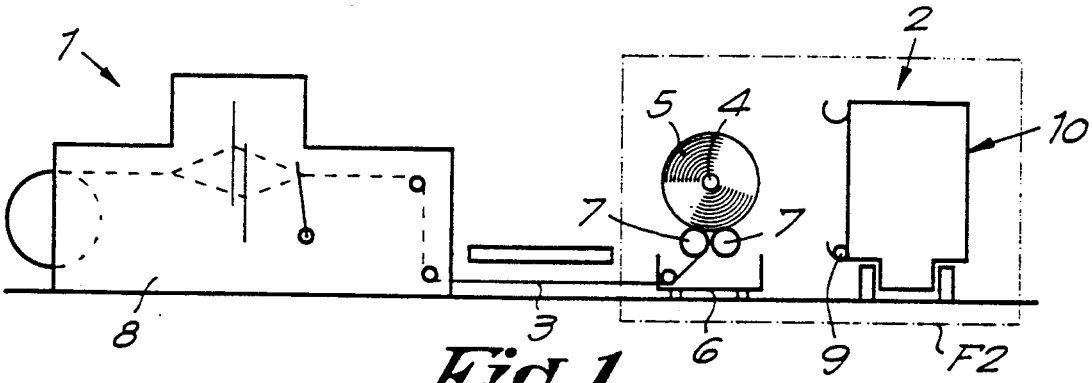
FIG. 1 is a schematic diagram of a device according to the invention.

FIG. 1 is a schematic diagram of a weaving machine 1 and a device 2 according to the invention. As is known, the produced fabric 3 is wound on a cloth beam 4 so as to form a cloth roll 5.

The cloth beam 4 may be mounted, as shown in FIG. 1, in a separate winding device 6 of the weaving machine 1, whereby the cloth beam 4 is supported by means of two support rolls 7, at least one of which is driven.

According to a variant, the winding device 6 for the cloth beam 4 may also be directly mounted in the frame 8 of the weaving machine 1.

Whenever the cloth beam 4 needs to be replaced, it is removed and replaced by an empty cloth beam 9. According to the present invention this is to be done as schematically represented in FIGS. 2 to 10. For clarity's sake, a number of parts of the device have been omitted in these figures, however they are described further on by means of a practical embodiment according to the invention.

Figure 2:
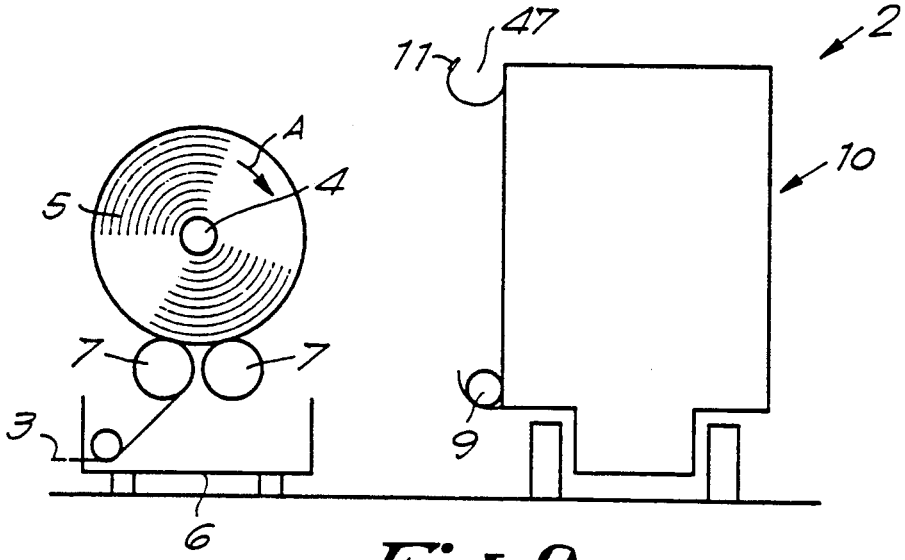
FIGS. 2 to 6 represent different stages of the method according to the invention for the part indicated in FIG. 1 as F2.

As indicated in FIG. 2, use is made of a transport element 10 to supply the empty cloth beam 9 and to remove the full cloth beam 4 in order to realize the method according to the invention. A guide piece 11 stretching out diagonally with respect to the fabric 3 and which is fixed onto the transport element 10 is an important element for implementing the method.

Figure 3:
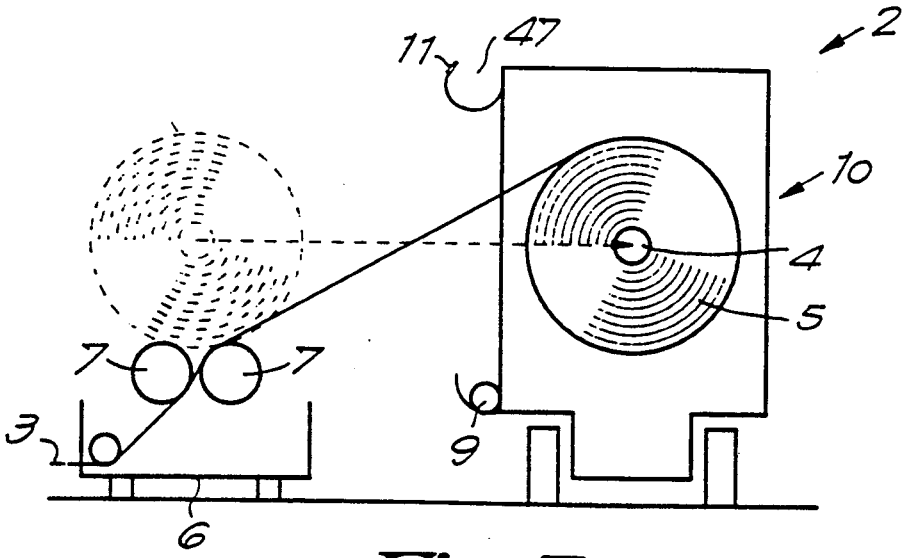

As shown in FIG. 3, according to the first stage of the method, the cloth beam 4 to be replaced and which is usually also full, is to be removed out of the winding device 6 and placed in the transport element 10. The fabric 3 between the winding device 6 and the full cloth beam 4 is kept taut.

Figure 4:
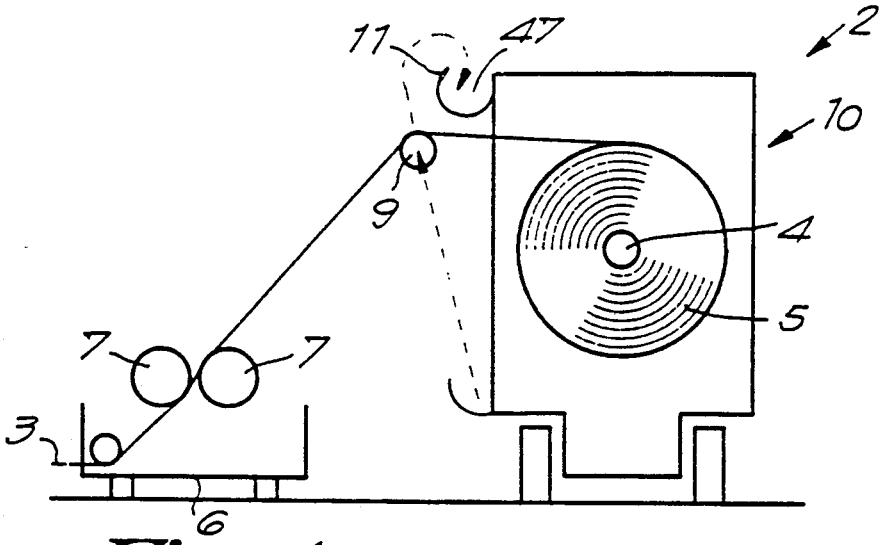
Figure 5:
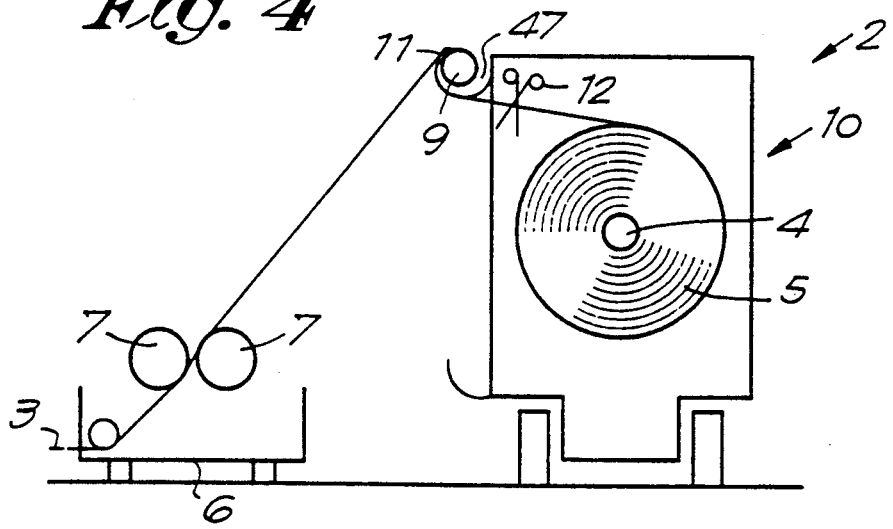

At the following stage, the empty cloth beam 9 as represented in FIG. 4 is pressed against the taut fabric, somewhere between the weaving machine and the removed cloth beam 4, and put over the edge of the guide piece 11 together with this fabric, such that the situation is as shown in FIG. 5. At this time, it is possible to remove fabric 3 from the cloth roll 5.

Figure 6:
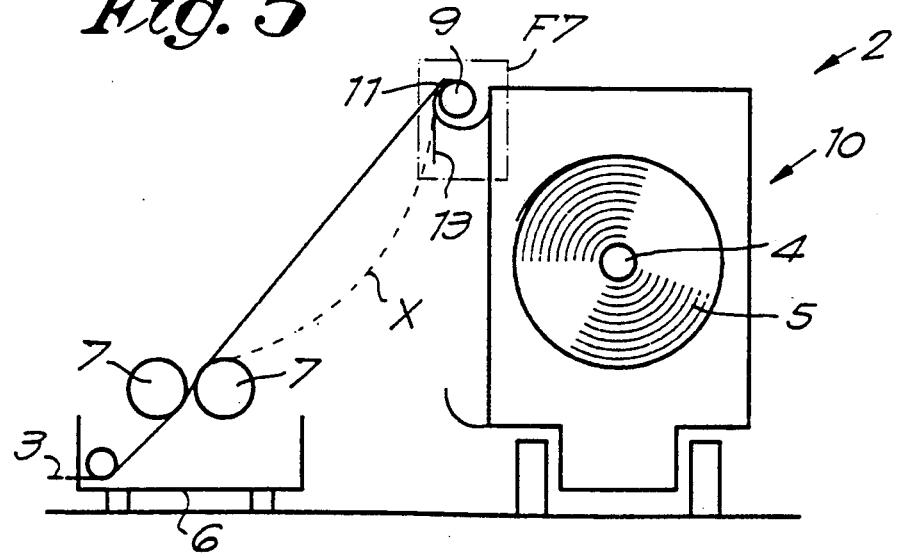

Subsequently, the full cloth beam 4 is emptied. To this end, at least according to the embodiment described, the fabric 3 between the guide piece 11 and the full cloth beam 4 is cut by means of a cutting device 12, for example as close as possible to the guide piece 11. Thus, as indicated in FIG. 6, a free end 13 is formed on the fabric 3, the other end of which is connected to the weaving machine.

Figure 7:
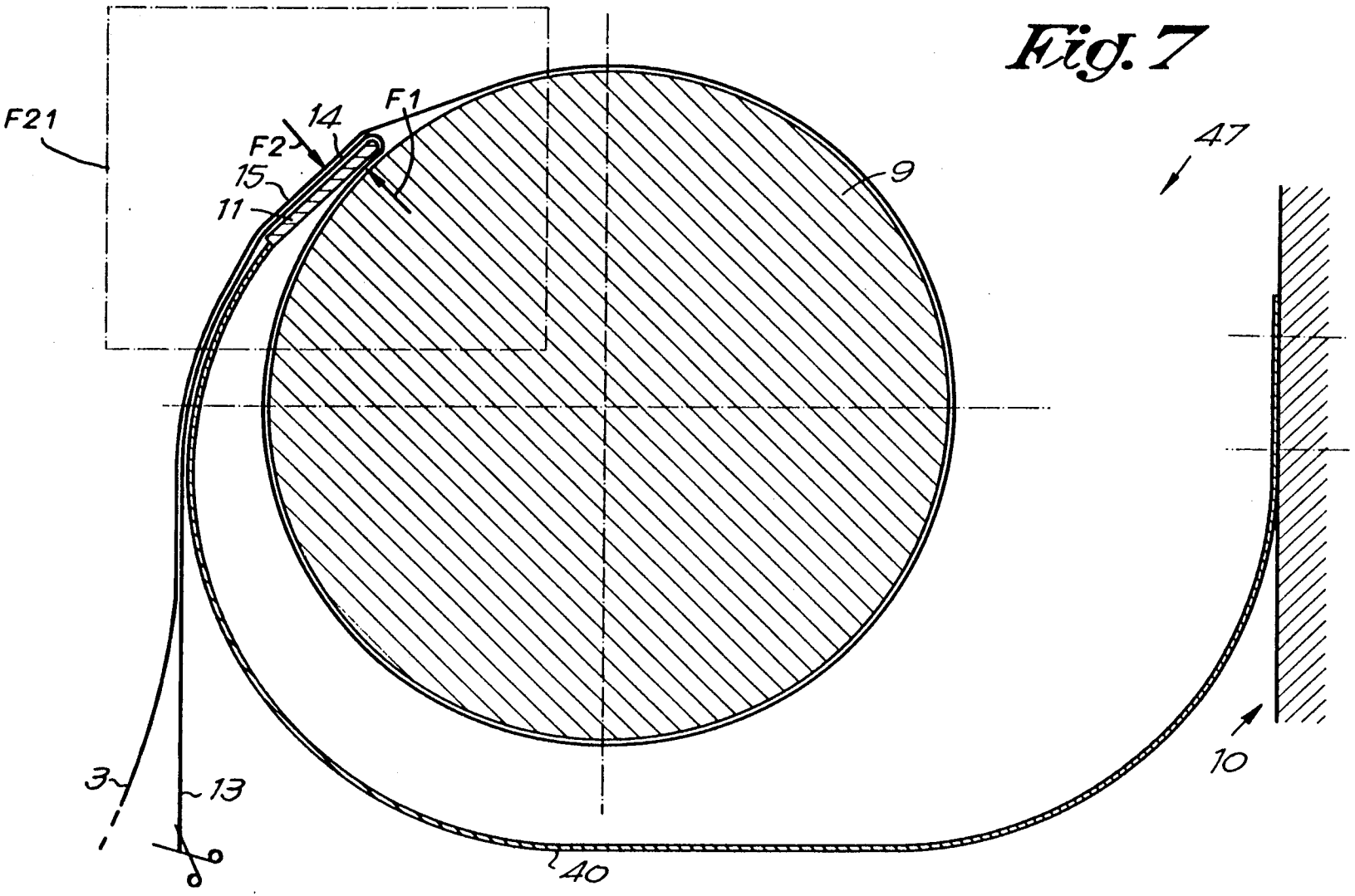
FIGS. 7 to 9 show a view to a larger scale of different positions of the part indicated in FIG. 6 as F7.

As shown in FIG. 7, the fabric 3 stretches out from the free end 13 to the guide piece 11, and makes a turn of practically 180 degrees over its free edge, to subsequently stretch out substantially around the circumference of the empty cloth beam 9, back over the guide piece 11 and towards weaving machine, in particular winding device 6, thus enveloping the fabric 3 that lies in between and is turned over the guide piece. The empty cloth beam 9 is pressed with a predetermined force F1 against the guide piece 11. The enveloping of fabric 3 that lies in between the extending portion and guide piece 11 is made possible as the portion of fabric 3 which stretches out towards the winding device 6 of the weaving machine 1 presses onto the portion of fabric 3 that lies in between the cloth beam and guide piece with a force F2, in particular onto part 14 of the fabric 3 which is situated between the guide piece 11 and part 15 of the fabric 3 which stretches out to the winding device 6. Parts 11, 14 and 15 are collectively referred to by the reference numeral F21 because a variation of these parts is shown in FIG. 21, described below.

Figure 8:
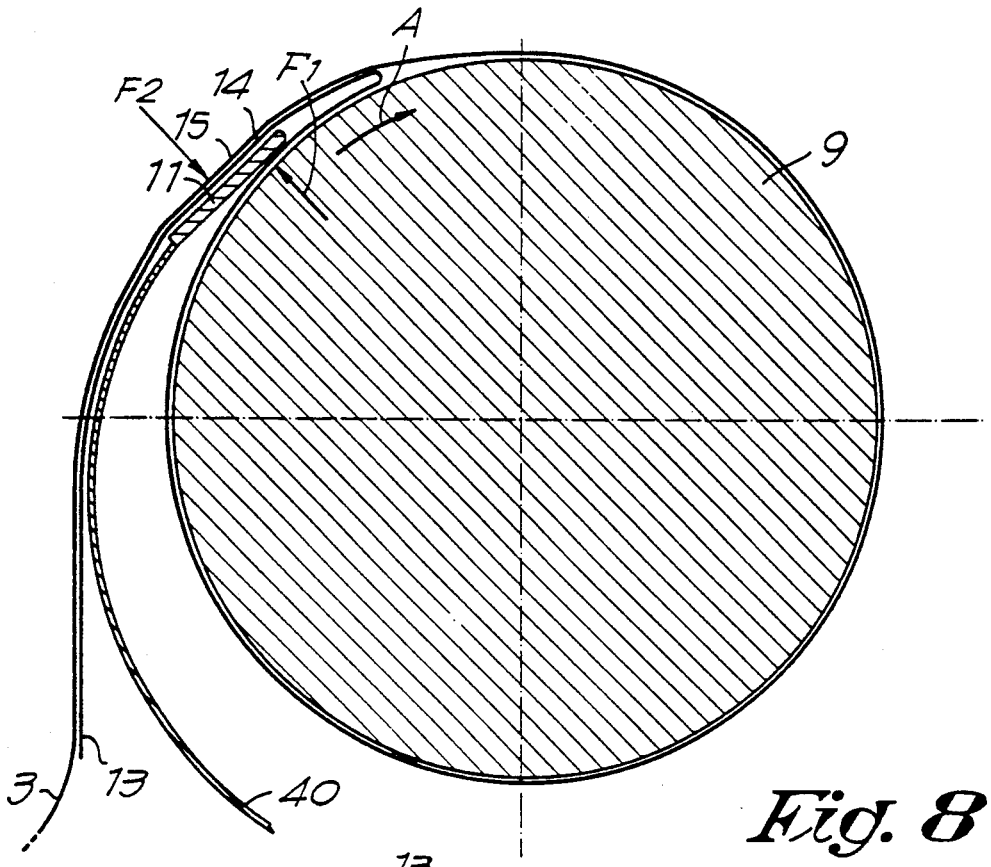
Figure 9:
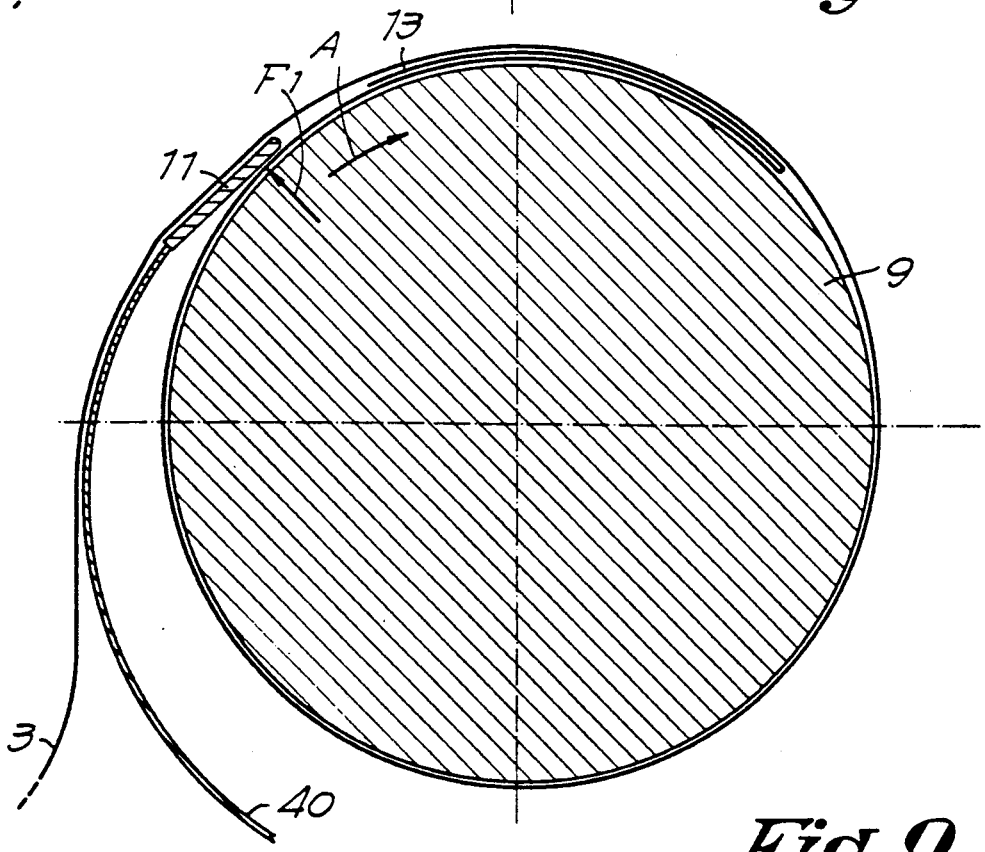

At the following stage, the empty cloth beam 9 is driven according to a winding sense A such that the fabric 3 is wound on the empty cloth beam 9. Of course, the winding sense A of the empty cloth beam 9 is the same as the winding sense of the cloth beam in the winding device 6. Hence, the intermediate part 14 of the fabric 3 is carried along at the height of the guide piece 11 resulting from friction with the opposite part 15, as shown in FIGS. 8 and 9, as a result of which the free end 13 is wound on the empty cloth beam 9. The intermediate part 14 is hereby carried along by the part 15 as the friction between the part 14 and the part 15 is greater than the friction between the part 14 and the guide piece 11. It is clear that such frictions result from the above-mentioned enveloping of the part 14.

Figure 10:
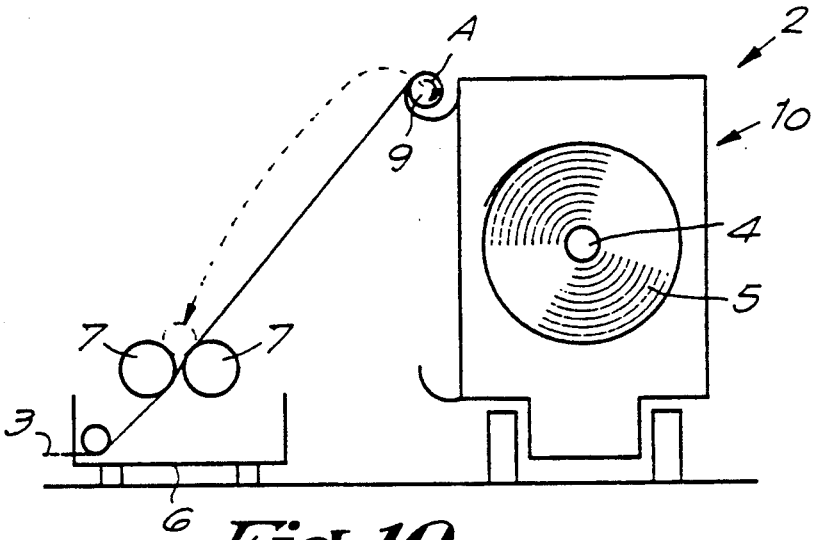
FIG. 10 is a schematic diagram of yet another stage of the method.

Finally, the empty cloth beam 9 is put back in the winding device 6, while the winding device is driven in the direction of arrow A so as to keep the fabric 3 between the empty cloth beam 9 and the weaving machine 1 is taut, as shown in FIG. 10. It is clear that in this case the empty cloth beam 9 has already been provided with some windings. Subsequently, the full cloth beam 4 can be carried off by means of a transport element 10.

A practical embodiment of the above-mentioned device 2 is hereafter described in connection with FIGS. 11 to 16. The device is at least made up of means for carrying off a cloth beam 4 to be replaced and to supply an empty cloth beam 9 to a weaving machine 1, a guide piece 11 stretching out diagonally in respect to the fabric 3; means for subsequently putting the empty cloth beam 9 against the fabric 3 and the guide piece 11 such that the fabric 3 is turned over the guide piece 11 and stretching out along most part of the circumference of the empty cloth beam 9 and again over the guide piece 11 towards the weaving machine, thus enveloping the fabric 3 that lies in between the guide piece 11 and the portion of cloth 3 extending towards the weaving machine 1. The preferred device also includes means for releasing the part of the fabric 3 which was formerly conducted to the full cloth beam 4; and drive means 16 to drive the empty cloth beam 9 which still has to be mounted in the weaving machine 1.

The means to carry off the full cloth beam 4 and to supply the empty cloth beam 9 include a transport element 10, and one or more mechanisms for removing a cloth beam 4 to be replaced from the weaving machine 1, in particular from the winding device 6, for putting cloth beam 4 in the transport element 10 on the one hand, and for installing the empty cloth beam 9, which is fixed in a holder or magazine 17 in the transport element 10, in place of the full cloth beam 4 in weaving machine 1. According to FIG. 11, two separate mechanisms 18 and 19 are used to this end.

The transport element 10 includes a carriage driven by a motor 20. Of course, the device as a whole is provided with the necessary means to call the transport element 10 and position it in front of the winding device 6 which contains the cloth beam 4 to be replaced. These means may for example include a detector 21 at the winding device 6 to detect a full cloth beam 4, a central control unit 22 which is connected, via an inductive rail 23 and a detector 24 in the transport element 10, to a control unit 25 which commands the motor 20 and the mechanisms 18 and 19. Whenever a cloth beam 4 is full, the detector 21 emits a signal as a result of which the transport element 10 automatically moves to the weaving machine 1 in question, following the inductive rail 23.

The above-mentioned mechanism 18 to carry off the full cloth beam 4 may consist for example of two telescopic arms 26, which can be horizontally extended, and a drive 27 by which the arms 26 can be vertically removed. At the far ends of the arms 26, seatings 28 have been applied in which a cloth beam 4 can be contained. The mechanism 18 allows for the arms 26 to be presented with the seatings 28 under the far ends of the cloth beam 4. By moving the arms 26 upward, the cloth beam 4 is lifted from the winding device 6 of the weaving machine 1, and by sliding in the telescopic arms 26, cloth beam 4 is placed in the transport element 10.

The above-mentioned mechanism 19 to put an empty cloth beam 9 in a weaving machine 1, and more particularly in the winding device 6, preferentially includes two telescopic arms 29 ends 30 of which are pivotally attached onto the frame 31 of the transport element 10, and ends 32 of which are each provided with a gripper element 33 to take up and remove the empty cloth beam 9. The telescopic arms 29 can be turned by means of pressure cylinders 34 or other known arm turning devices.

Figure 13:
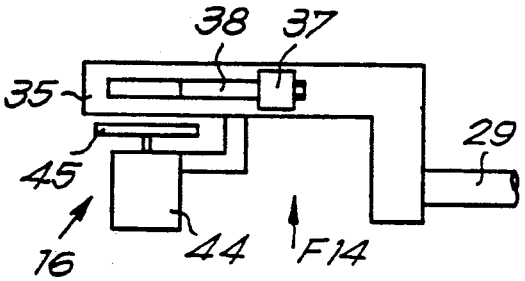
Figure 14:
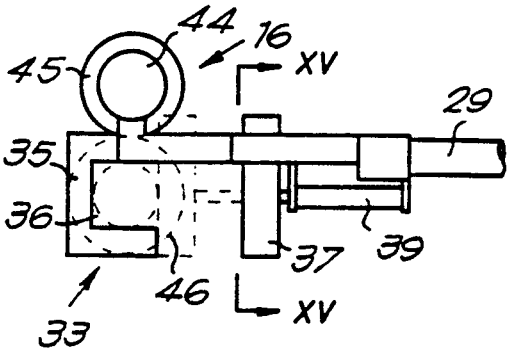
FIG. 14 shows a view according to arrow F14 in FIG. 13.

As shown in FIGS. 13 to 15, the gripper elements 33 may include a hook-shaped part 35 with an opening 36 in which the far end of cloth beam 9 fits and a locking element 37 to prevent the far end of the cloth beam 9 from coming loose from the hook-shaped part 35 in which it has been mounted. The locking elements 37 may include slides which move in guide pieces 38 of arms 29 and which are removed by means of pressure cylinders 39.

The above-mentioned means to press the empty cloth beam 9 against the fabric 3 and against the guide piece 11 are also formed by the mechanism 19 described above in the embodiment represented in FIGS. 11 to 15. It is clear that the mechanism 19 allows one to both take an empty cloth beam 9 from the magazine and holder 17 and to remove it as shown in FIGS. 4, 5 and 10.

The above-mentioned guide piece 11 preferably includes a thin slat with a smooth surface and which is attached onto the frame 31 of the transport element 10 by means of arched connecting pieces 40, as shown in FIGS. 7, 8, 9, 11 and 12. The connecting pieces 40 may be either elastic or not elastic.

If the connecting pieces 40 are elastic, the guide piece 11 and the cloth beam 9 make full contact over their entire length as the cloth beam 9 is pressed according to the situation shown in FIG. 7, and alignment mistakes can be adjusted. According to a variant, the slat which forms the guide piece 11 may consist of a leaf spring.

Figure 11:
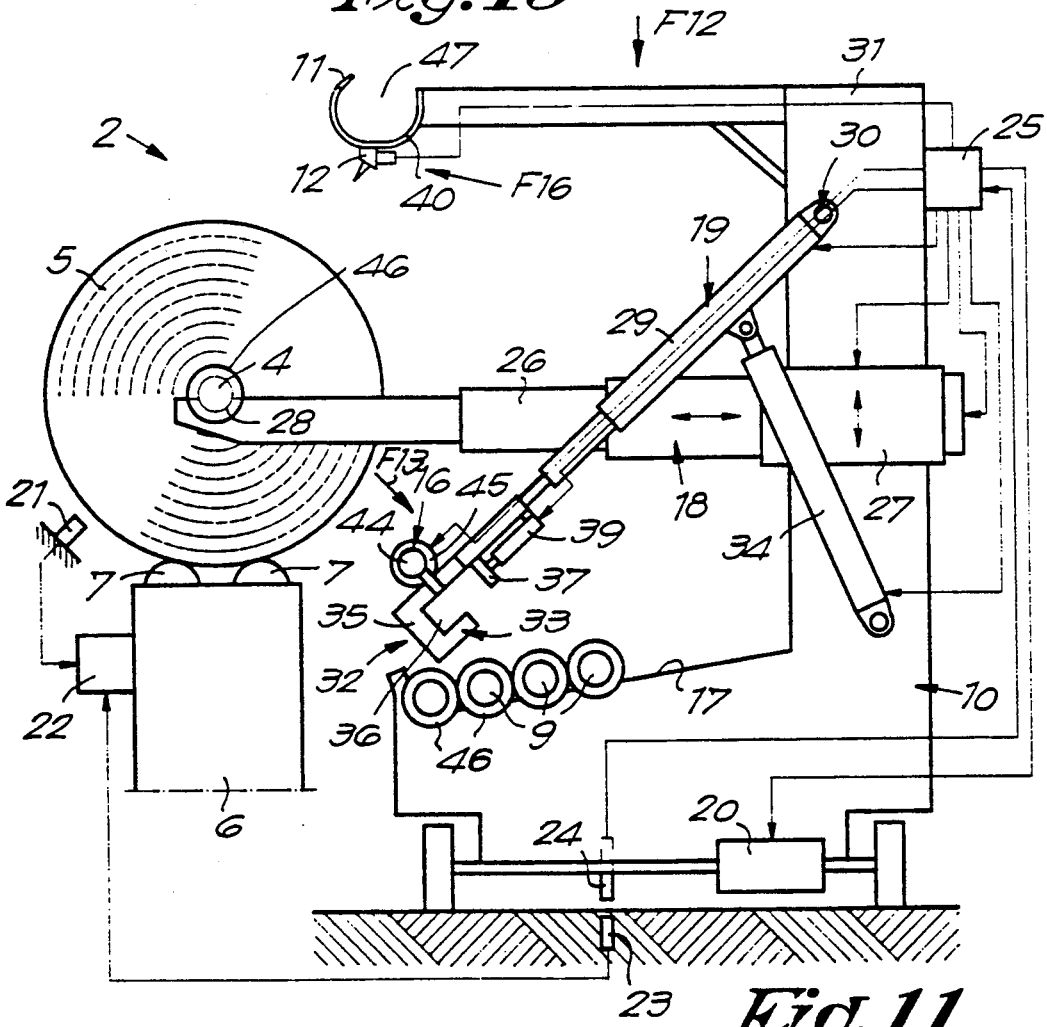
FIG. 11 shows a practical embodiment of the device according to the invention.
Figure 12:
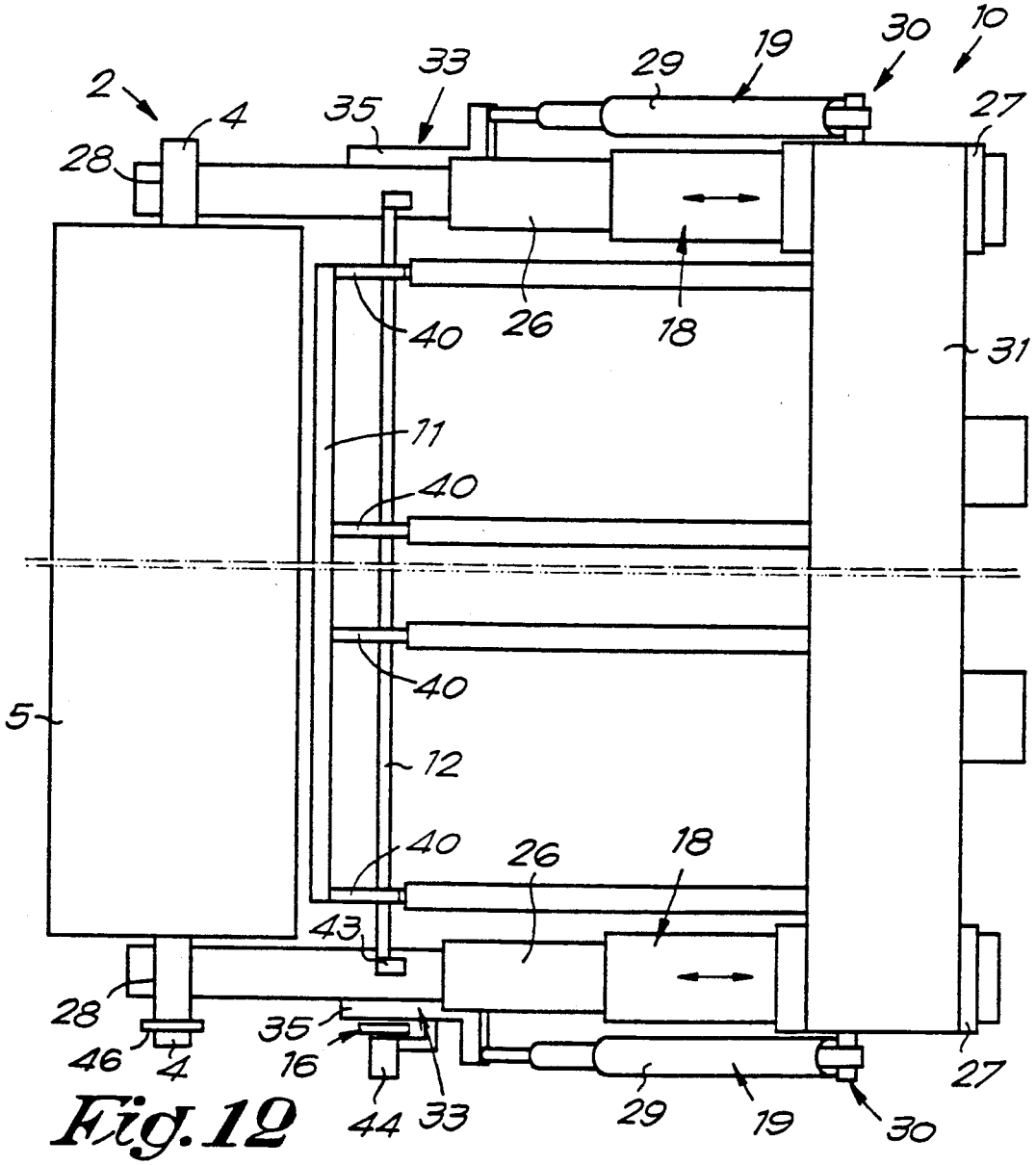
FIGS. 12 and 13 show views according to the arrows F12 and F13 in FIG. 11.

The above-mentioned means to release the fabric 3 from the full cloth beam 4 include a cutting device 12 which operates parallel to the guide piece 11, as shown in FIGS. 11 and 12. To this end, the cutting device 12 has been attached to the bottom side of the connecting pieces 40. They include a V-shaped knife 41 which can be removed by means of a cable 42 and a motor 43 as is schematically represented in FIG. 16. According to this method, the fabric 3 automatically comes within reach of the cutting device 12. As the telescopic arms 26 are slid in, the cloth beam 4 is unwound while it remains in the seatings 28, as a result of which the fabric 3 is kept taut. It is clear that in order to keep the fabric 3 taut, a certain friction is required between the cloth beam 4 and the seatings 28. Also as the empty cloth beam 9 is pressed against the fabric 3, the latter remains taut such that it will always stretch out from the bottom of the guide piece 11 to the cloth beam 9, and will always come within reach of the cutting device 12.

The above-mentioned drive means 16 consist of a motor 44, for example an electrical motor, with which a cloth beam 9 mounted in the gripper elements 33 can be turned. As shown in FIGS. 13 to 15, the motor 44 has been attached on one of the arms 29 of the mechanism 19 and drives a sliding coupling which may be formed of for example a drive wheel 45 which may cooperate with a wheel 46 on the cloth beam 9. The drive wheel 45 may include a rubber wheel, whereas the wheel 46 may have a smooth surface.

It is clear that all drive means, such as the motors 20, 43 and 44, the telescopic arms 26 and 29 and the pressure cylinders 34 and 39 are controlled by means of control unit 25 such that the cycle as shown in FIGS. 1 to 10 is automatically carried out.

It should be noted that after the situation in FIG. 5 has been realized, the fabric 3 hangs looser as indicated in FIG. 6 by means of the dashed line X, at least when no extra clamping means have been provided, and when the weaving on weaving machine 1 continues. For this reason, the guide piece 11 should in preference be attached on top of the frame 31, as a result of which the fabric's 3 own weight provides the necessary tension to carry along the part 14 during the winding, as shown in FIG. 8. In this case, the opening 47 of the arched connecting pieces 40 is also pointed to the top.

FIGS. 17 to 20 show a variant for replacing the cloth beam 4 which is attached to winding device 6 mounted in the frame 8 of weaving machine 1. It differs from the above-mentioned embodiment in that the winding sense B is in this case usually opposite to the winding sense A of a separating winding device 6. The guide piece 11 and the connecting pieces 40 should be assembled accordingly.

In the embodiment according to FIGS. 17 to 20, the guide piece 11 is situated under the transport element 10, whereas the holder 17 for the empty cloth beam 9 is situated at the top. The opening 47 of the arched connecting pieces 40 is pointed to the bottom.

By way of example, the means to carry off the cloth beam 4 to be replaced and to supply the empty cloth beam 9 to the weaving machine 1, as well as the means to put the empty cloth beam 9 subsequently to the fabric 3 and the guide piece 11 is formed by one and the same mechanism 48. This mechanism 48 consists of two folding arms 49 which are attached onto frame 31 in a hingeable manner. Each arm can be hinged and can be driven by means of drive mechanisms 50 and 51 respectively. The free end of each of arms 49 is provided with a gripper element 33 as shown in FIGS. 13 to 15.

The cutting device 12 has now been mounted at the top side of the arched connecting pieces 40.

The device is also provided with a drive 52 to turn the cloth beam 4 once it has been placed in the transport element 10. As shown in FIGS. 17 to 20, this drive may consist of an electrical motor 53, a transmission 54 and sliding coupling 55. The sliding coupling 55 may consist of a rubber wheel 56 which cooperates with a supporting roller mechanism 57 for the cloth beam 4.

The supporting roller mechanism 57 is part of a support 58 intended to permit the cloth beam 4 to be replaced after it has been removed from the weaving machine 1.

Figure 19:
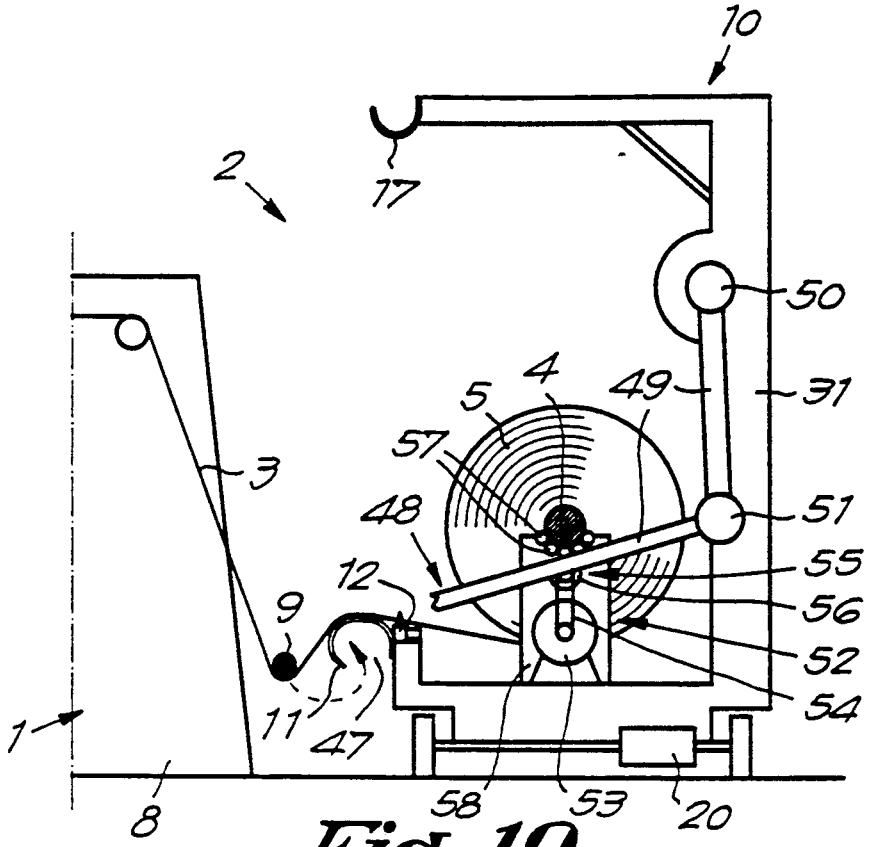
Figure 20:
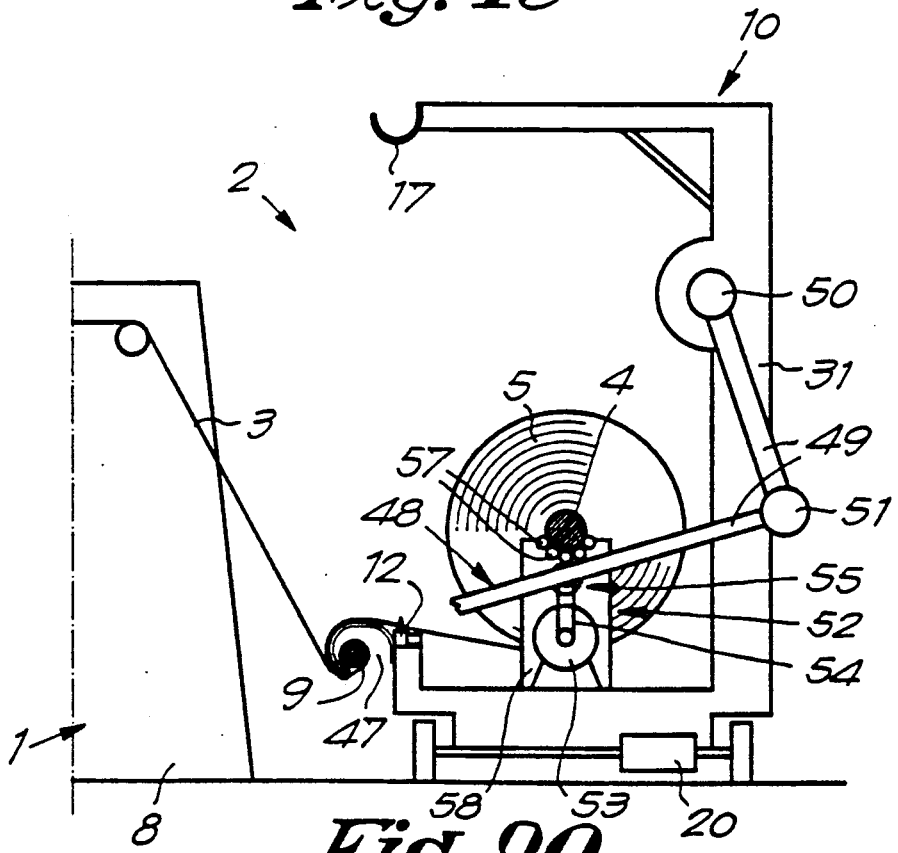

In order to clearly show the position of the empty cloth beam 9, the arms 49 in FIGS. 19 and 20 are only partly represented.

The operation of the device can easily be derived from the different positions in FIGS. 17 to 20.

Figure 17:
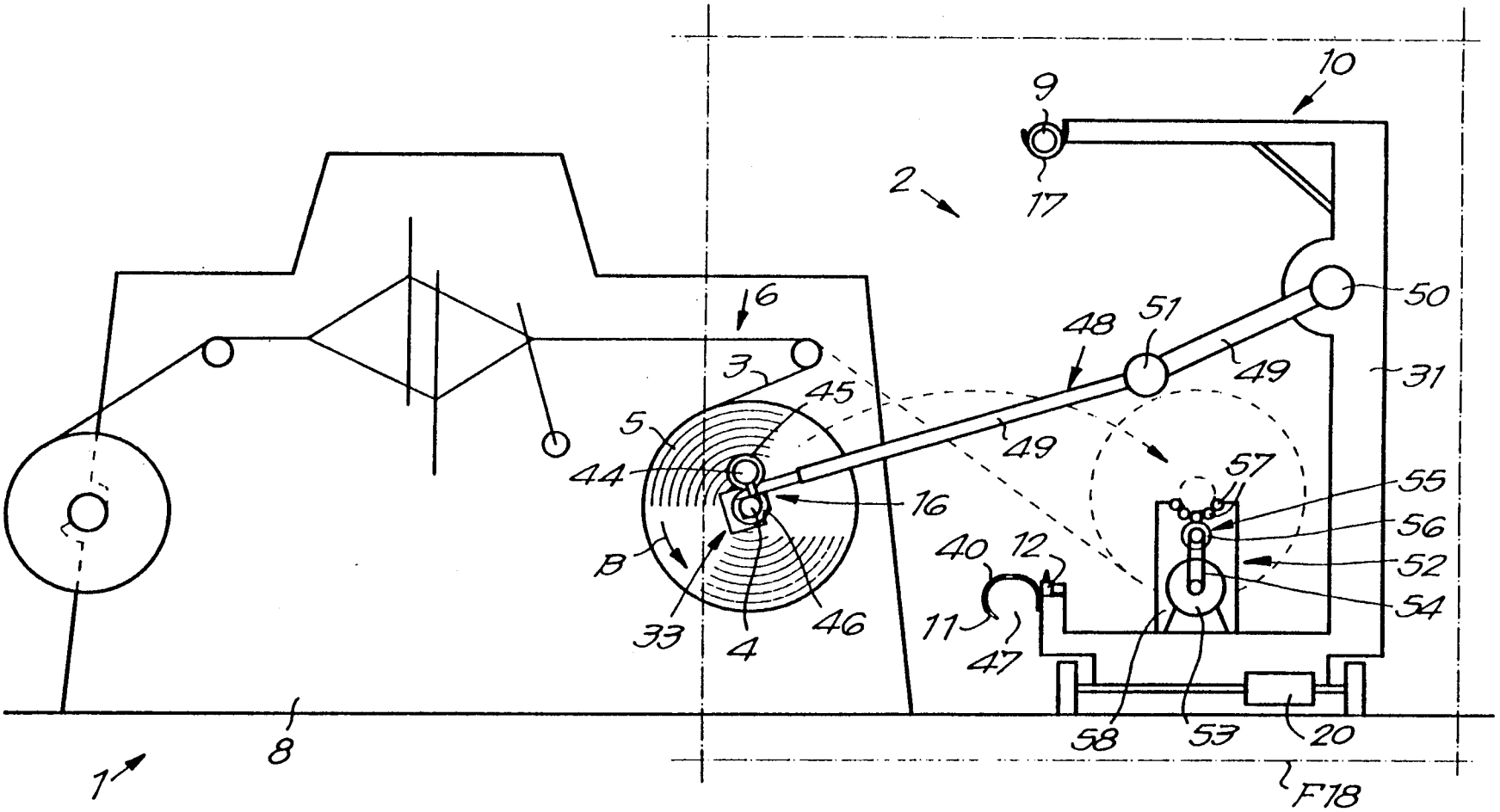
FIG. 17 represents a variant of the device according to the invention.

According to FIG. 17, the full cloth beam 4 is taken up by the mechanism 48. Subsequently, it is moved and put in the support 58, which results in a situation as shown in FIG. 18, after which the mechanism 48 moves to the holder 17 to take up an empty cloth beam 9.

The empty cloth beam 9 is pressed against the fabric 3 and put in the opening 47 of the arched connecting pieces 40, as shown in FIG. 19. Subsequently, the empty cloth beam 9 is pressed against the guide piece 11. Hereby, the fabric 3 is constantly kept taut by switching on the drive 52.

Subsequently, the fabric 3 is cut loose from the full cloth beam 4 by means of the above-mentioned cutting device 12. Immediately hereafter, the empty cloth beam 4 is driven such that the fabric 3 can be wound in an analogous manner as indicated in FIGS. 7, 8 and 9.

In this case, the connecting pieces 40 are in preference elastic, such that the empty cloth beam 9 can be tightened against the guide piece 11, against the resilience, by winding up the full cloth beam 4. This offers the advantage that the fabric 3 which stretches out from the empty cloth beam 9 to the weaving machine 1 remains taut for a while, as the connecting pieces 40 spring back, even when the weaving is continued while the cloth beam is being replaced. The resilience effectively replaces the force supplied in the embodiment according to FIG. 7 by the fabric's own weight.

It is clear that the drive of the empty cloth beam 9 by the motor 44 does not necessarily have to be assured via the above-mentioned sliding couplings. Use may also be made of for example a gear transmission or such. In this case, the drive wheel 45 may consist of a gear wheel, for example, which may cooperate with a wheel 46 on the cloth beam 9 which in this case consists of a gear wheel, and the motor 44 may consist of, for example, a motor with a constant torque.

FIG. 21 shows a variant according to which the guide piece 11 is formed by a slat 59 equipped with rotatable needles 60, needles 60 having been applied a the side 61 of the slat 59 pointed towards the fabric 3 which stretches out to the winding device 6. As a result, the friction between the part 14 and the guide piece 11 is reduced, which makes it easier for the part 14 to be carried along by the part 15.

It is clear that the guide piece 11 does not necessarily need to be fixed onto the frame of the transport element 10, but that the guide piece 11 can also be fixed onto the frame of another element such as for example the winding device 6 of the weaving machine 1.

It is clear that the width of the device according to the invention may be adjusted to the width of the cloth beam to be replaced.

The present invention is in no way limited to the embodiments described by way of example and shown in the accompanying drawings; on the contrary, such a method and device for replacing a cloth beam in weaving machines can be made in all sorts of variants while still remaining within the scope of the invention.

We claim:

1. A method of replacing a cloth beam in a weaving machine, comprising the steps of: removing a cloth beam from a cloth winding device; pressing an empty cloth beam against a fabric extending from the removed cloth beam, and against a guide piece fixed to a frame and extending along a width of the fabric, to thereby cause the fabric to turn over the guide piece and extend substantially around the circumference of the empty cloth beam and to extend from the empty cloth beam towards the winding device, a portion of the fabric which extends towards the winding device enveloping a portion of the fabric which is turned over the guide piece and which lies between the guide piece and the portion of the fabric which extends towards the winding device; releasing a part of the fabric that is situated, with respect to a moving direction of the fabric, beyond the empty cloth beam; driving the empty cloth beam such that the part of the fabric that is situated beyond the empty cloth beam is wound between the guide piece and the portion of the fabric which extends towards the winding device; and mounting the empty cloth beam in the winding device.

2. A method as claimed in claim 1, wherein the step of pressing the empty cloth beam against a fabric extending from the remove cloth beam, and against the guide piece, comprises the step of pressing the empty cloth beam against the guide piece with a predetermined force as the empty cloth beam is put against the arm 2 guide piece.

3. A method as claimed in claim 1, wherein the step of driving the empty cloth beam comprises the step of driving the empty cloth beam with a constant torque.

4. A method as claimed in claim 1, wherein the step of releasing a part of the fabric comprises the step of releasing the part of the fabric after the empty cloth beam and the fabric have made contact with the guide piece.

5. A method as claimed in claim 1, wherein said step of driving the empty cloth beam comprises the step of continuing to drive the empty cloth beam as the empty cloth beam is placed in the winding device.

6. A device for replacing a cloth beam in a weaving machine, comprising: means for removing a cloth beam from a cloth winding device; means for pressing an empty cloth beam against a fabric extending from the removed cloth beam, and against a guide piece fixed to a frame and extending along a width of the fabric, to thereby cause the fabric to turn over the guide piece and extend substantially around the circumference of the empty cloth beam and from the empty cloth beam towards the winding device, a portion of the fabric which extends towards the winding device enveloping a portion of the fabric which is turned over the guide piece and which lies between the guide piece and the portion of the fabric which extends towards the winding device; means for releasing a part of the fabric that is situated, with respect to a moving direction of the fabric, beyond the empty cloth beam; means for driving the empty cloth beam such that the part of the fabric that is situated beyond the empty cloth beam is wound between the guide piece and the portion of the fabric which extends towards the winding device; and means for mounting the empty cloth beam in the winding device.

7. A device as claimed in claim 6, wherein said guide piece comprises a slat which extends in a direction of a width of the fabric.

8. A device as claimed in claim 6, wherein said guide piece is mounted on arched connecting pieces fixed to the frame.

9. A device as claimed in claim 8, wherein said connecting pieces are elastic.

10. A device as claimed in claim 6, wherein said means for pressing an empty cloth beam against the fabric extending from the removed cloth beam, and against the guide piece, comprises means including arms provided with two gripper elements for taking up the empty cloth beam.

11. A device as claimed in claim 10, wherein said means for taking up the empty cloth beam comprise part of said driving means for driving the empty cloth beam.

12. A device as claimed in claim 11, wherein said drive means comprises means including a motor for driving a drive wheel, said drive wheel including means for cooperating with said empty cloth beam to drive said empty cloth beam.

13. A device as claimed in claim 12, wherein said drive means comprises a sliding coupling.

14. A device as claimed in claim 6, wherein said guide piece is fixed onto a transport element having means for supplying an empty cloth beam and for carrying off a cloth beam to be replaced, said supplying and carrying off means comprising said means for removing a cloth beam from the winding device, said means for pressing the empty cloth beam against the fabric and the guide piece and means for placing the empty cloth beam in the winding device, said means for releasing the part of the fabric which according to the moving direction of the fabric is situated beyond the empty cloth beam, and said drive means for driving the empty cloth beam.

* * * * *